US009133758B2

(12) United States Patent
Meldolesi et al.

(10) Patent No.: US 9,133,758 B2
(45) Date of Patent: Sep. 15, 2015

(54) SPLIT-CYCLE AIR-HYBRID ENGINE WITH AIR EXPANDER AND FIRING MODE

(71) Applicants: Riccardo Meldolesi, Shoreham-by-Sea (GB); Nicholas Badain, Shoreham-by-Sea (GB); Ian Gilbert, Shoreham-by-Sea (GB)

(72) Inventors: Riccardo Meldolesi, Shoreham-by-Sea (GB); Nicholas Badain, Shoreham-by-Sea (GB); Ian Gilbert, Shoreham-by-Sea (GB)

(73) Assignee: SCUDERI GROUP, INC.

( * ) Notice: Subject to any disclaimer, the term of this patent is extended or adjusted under 35 U.S.C. 154(b) by 24 days.

(21) Appl. No.: 14/179,644

(22) Filed: Feb. 13, 2014

(65) Prior Publication Data

US 2014/0158102 A1 Jun. 12, 2014

Related U.S. Application Data

(63) Continuation of application No. 13/046,813, filed on Mar. 14, 2011, now Pat. No. 8,677,953.

(60) Provisional application No. 61/313,831, filed on Mar. 15, 2010, provisional application No. 61/363,825, filed on Jul. 13, 2010, provisional application No. 61/365,343, filed on Jul. 18, 2010.

(51) Int. Cl.
*F02B 33/00* (2006.01)
*F02B 33/22* (2006.01)
(Continued)

(52) U.S. Cl.
CPC ..... *F02B 33/22* (2013.01); *F02B 41/06* (2013.01); *F02B 2075/025* (2013.01)

(58) Field of Classification Search
CPC .... F02B 33/22; F02B 41/06; F02B 2075/025; F02B 3/06; F02B 75/18; F02B 75/228
USPC ..... 123/68, 70 R, 53.5
See application file for complete search history.

(56) References Cited

U.S. PATENT DOCUMENTS 1,062,999 A 5/1913 Webb
1,350,570 A 8/1920 Sarjent
(Continued)

FOREIGN PATENT DOCUMENTS

JP 07-054659 2/1995
JP H10-512031 11/1998
(Continued)

OTHER PUBLICATIONS

English language abstract of JP07-054659.
(Continued)

*Primary Examiner* — Lindsay Low
*Assistant Examiner* — Syed O Hasan

(57) ABSTRACT

A split-cycle air hybrid engine includes a rotatable crankshaft. A compression piston is slidably received within a compression cylinder and operatively connected to the crankshaft. An expansion piston is slidably received within an expansion cylinder and operatively connected to the crankshaft. A crossover passage interconnects the compression and expansion cylinders. The crossover passage includes a crossover compression (XovrC) valve and a crossover expansion (XovrE) valve defining a pressure chamber therebetween. An air reservoir is operatively connected to the crossover passage. An air reservoir valve selectively controls air flow into and out of the air reservoir. In an Air Expander and Firing (AEF) mode of the engine, the engine has a residual expansion ratio at XovrE valve closing of 15.7 to 1 or greater, and more preferably in the range of 15.7 to 1 and 40.8 to 1.

8 Claims, 8 Drawing Sheets

(51) Int. Cl.

| | |
|---|---|
| ***F02B 75/24*** | (2006.01) |
| ***F02B 41/06*** | (2006.01) |
| *F02B 75/02* | (2006.01) |

(56) References Cited

U.S. PATENT DOCUMENTS

| | | | |
|---|---|---|---|
| 4,696,158 | A | 9/1987 | DeFrancisco |
| 6,415,749 | B1 | 7/2002 | Sturman et al. |
| 6,655,327 | B1 | 12/2003 | Hedman |
| 7,353,786 | B2 | 4/2008 | Scuderi et al. |
| 7,603,970 | B2 | 10/2009 | Scuderi et al. |
| 7,637,234 | B2 | 12/2009 | Tussing et al. |
| 2004/0255882 | A1 | 12/2004 | Branyon et al. |
| 2005/0016475 | A1 | 1/2005 | Scuderi et al. |
| 2006/0124085 | A1 | 6/2006 | Luttgeharm |
| 2007/0157894 | A1 | 7/2007 | Scuderi et al. |
| 2008/0105225 | A1 | 5/2008 | Scuderi et al. |
| 2008/0202454 | A1 | 8/2008 | Pirault |
| 2009/0272368 | A1 | 11/2009 | Branyon et al. |

FOREIGN PATENT DOCUMENTS

| | | |
|---|---|---|
| JP | 2006-316681 | 11/2006 |
| JP | 2006-528741 | 12/2006 |
| JP | 2007-521439 | 8/2007 |
| JP | 2010-522837 | 7/2010 |
| KR | 10-2010-0028666 | 3/2010 |

OTHER PUBLICATIONS

English language abstract of JP2010-522837.
English language abstract of JP H10-512031.
English language abstract of JP2006-316681.

SPLIT-CYCLE AIR-HYBRID ENGINE WITH AIR EXPANDER AND FIRING MODE

CROSS-REFERENCE TO RELATED APPLICATIONS

This application is a continuation of U.S. application Ser. No. 13/046,813 filed Mar. 14, 2011, which claims the priority of U.S. Provisional Application No. 61/313,831 filed Mar. 15, 2010, U.S. Provisional Application No. 61/363,825 filed Jul. 13, 2010, and U.S. Provisional Application No. 61/365,343 filed Jul. 18, 2010.

TECHNICAL FIELD

This invention relates to split-cycle engines and, more particularly, to such an engine incorporating an air hybrid system.

BACKGROUND OF THE INVENTION

For purposes of clarity, the term "conventional engine" as used in the present application refers to an internal combustion engine wherein all four strokes of the well-known Otto cycle (i.e., the intake (or inlet), compression, expansion (or power) and exhaust strokes) are contained in each piston/cylinder combination of the engine. Each stroke requires one half revolution of the crankshaft (180 degrees crank angle (CA)), and two full revolutions of the crankshaft (720 degrees CA) are required to complete the entire Otto cycle in each cylinder of a conventional engine.

Also, for purposes of clarity, the following definition is offered for the term "split-cycle engine" as may be applied to engines disclosed in the prior art and as referred to in the present application.

A split-cycle engine as referred to herein comprises:

a crankshaft rotatable about a crankshaft axis;

a compression piston slidably received within a compression cylinder and operatively connected to the crankshaft such that the compression piston reciprocates through an intake stroke and a compression stroke during a single rotation of the crankshaft;

an expansion (power) piston slidably received within an expansion cylinder and operatively connected to the crankshaft such that the expansion piston reciprocates through an expansion stroke and an exhaust stroke during a single rotation of the crankshaft; and a crossover passage (port) interconnecting the compression and expansion cylinders, the crossover passage including at least a crossover expansion (XovrE) valve disposed therein, but more preferably including a crossover compression (XovrC) valve and a crossover expansion (XovrE) valve defining a pressure chamber therebetween.

U.S. Pat. No. 6,543,225 granted Apr. 8, 2003 to Scuderi and U.S. Pat. No. 6,952,923 granted Oct. 11, 2005 to Branyon et al., both of which are incorporated herein by reference, contain an extensive discussion of split-cycle and similar-type engines. In addition, these patents disclose details of prior versions of an engine of which the present disclosure details further developments.

Split-cycle air-hybrid engines combine a split-cycle engine with an air reservoir and various controls. This combination enables a split-cycle air-hybrid engine to store energy in the form of compressed air in the air reservoir. The compressed air in the air reservoir is later used in the expansion cylinder to power the crankshaft.

A split-cycle air-hybrid engine as referred to herein comprises:

a crankshaft rotatable about a crankshaft axis;

a compression piston slidably received within a compression cylinder and operatively connected to the crankshaft such that the compression piston reciprocates through an intake stroke and a compression stroke during a single rotation of the crankshaft;

an expansion (power) piston slidably received within an expansion cylinder and operatively connected to the crankshaft such that the expansion piston reciprocates through an expansion stroke and an exhaust stroke during a single rotation of the crankshaft;

a crossover passage (port) interconnecting the compression and expansion cylinders, the crossover passage including at least a crossover expansion (XovrE) valve disposed therein, but more preferably including a crossover compression (XovrC) valve and a crossover expansion (XovrE) valve defining a pressure chamber therebetween; and an air reservoir operatively connected to the crossover passage and selectively operable to store compressed air from the compression cylinder and to deliver compressed air to the expansion cylinder.

U.S. Pat. No. 7,353,786 granted Apr. 8, 2008 to Scuderi et al., which is incorporated herein by reference, contains an extensive discussion of split-cycle air-hybrid and similar-type engines. In addition, this patent discloses details of prior hybrid systems of which the present disclosure details further developments.

A split-cycle air-hybrid engine can be run in a normal operating or firing (NF) mode (also commonly called the Engine Firing (EF) mode) and four basic air-hybrid modes. In the EF mode, the engine functions as a non-air hybrid split-cycle engine, operating without the use of its air reservoir. In the EF mode, a tank valve operatively connecting the crossover passage to the air reservoir remains closed to isolate the air reservoir from the basic split-cycle engine.

The split-cycle air-hybrid engine operates with the use of its air reservoir in four hybrid modes. The four hybrid modes are:

1) Air Expander (AE) mode, which includes using compressed air energy from the air reservoir without combustion;
2) Air Compressor (AC) mode, which includes storing compressed air energy into the air reservoir without combustion;
3) Air Expander and Firing (AEF) mode, which includes using compressed air energy from the air reservoir with combustion; and
4) Firing and Charging (FC) mode, which includes storing compressed air energy into the air reservoir with combustion.

However, further optimization of these modes, EF, AE, AC, AEF and FC, is desirable to enhance efficiency and reduce emissions.

SUMMARY OF THE INVENTION

The present invention provides a split-cycle air-hybrid engine in which the use of the Air Expander and Firing (AEF) mode is optimized for potentially any vehicle in any drive cycle for improved efficiency.

More particularly, an exemplary embodiment of a split-cycle air-hybrid engine in accordance with the present invention includes a crankshaft rotatable about a crankshaft axis. A compression piston is slidably received within a compression cylinder and operatively connected to the crankshaft such that the compression piston reciprocates through an intake stroke and a compression stroke during a single rotation of the crankshaft. An expansion piston is slidably received within an expansion cylinder and operatively connected to the crankshaft such that the expansion piston reciprocates through an expansion stroke and an exhaust stroke during a single rotation of the crankshaft. A crossover passage interconnects the compression and expansion cylinders. The crossover passage includes a crossover compression (XovrC) valve and a crossover expansion (XovrE) valve defining a pressure chamber therebetween. An air reservoir is operatively connected to the crossover passage and selectively operable to store compressed air from the compression cylinder and to deliver compressed air to the expansion cylinder. An air reservoir valve selectively controls air flow into and out of the air reservoir. The engine is operable in an Air Expander and Firing (AEF) mode. In the AEF mode, the engine has a residual expansion ratio at XovrE valve closing of 15.7 to 1 or greater, and more preferably in the range of 15.7 to 1 and 40.8 to 1.

A method of operating a split-cycle air-hybrid engine is also disclosed. The split-cycle air-hybrid engine includes a crankshaft rotatable about a crankshaft axis. A compression piston is slidably received within a compression cylinder and operatively connected to the crankshaft such that the compression piston reciprocates through an intake stroke and a compression stroke during a single rotation of the crankshaft. An expansion piston is slidably received within an expansion cylinder and operatively connected to the crankshaft such that the expansion piston reciprocates through an expansion stroke and an exhaust stroke during a single rotation of the crankshaft. A crossover passage interconnects the compression and expansion cylinders. The crossover passage includes a crossover compression (XovrC) valve and a crossover expansion (XovrE) valve defining a pressure chamber therebetween. An air reservoir is operatively connected to the crossover passage and selectively operable to store compressed air from the compression cylinder and to deliver compressed air to the expansion cylinder. An air reservoir valve selectively controls air flow into and out of the air reservoir. The engine is operable in an Air Expander and Firing (AEF) mode. The method in accordance with the present invention includes the following steps: opening the air reservoir valve; admitting compressed air from the air reservoir into the expansion cylinder with fuel, at the beginning of an expansion stroke, the fuel being ignited, burned and expanded on the same expansion stroke of the expansion piston, transmitting power to the crankshaft, and the combustion products being discharged on the exhaust stroke; and maintaining a residual expansion ratio at XovrE valve closing of 15.7 to 1 or greater, and more preferably in the range of 15.7 to 1 and 40.8 to 1.

These and other features and advantages of the invention will be more fully understood from the following detailed description of the invention taken together with the accompanying drawings.

DETAILED DESCRIPTION OF THE INVENTION

The following glossary of acronyms and definitions of terms used herein is provided for reference.

In General

Unless otherwise specified, all valve opening and closing timings are measured in crank angle degrees after top dead center of the expansion piston (ATDCe).

Unless otherwise specified, all valve durations are in crank angle degrees (CA).

Air tank (or air storage tank): Storage tank for compressed air.

ATDCe: After top dead center of the expansion piston.

Bar: Unit of pressure, 1 bar=$10^5$ N/$m^2$

BMEP: Brake mean effective pressure. The term "Brake" refers to the output as delivered to the crankshaft (or output shaft), after friction losses (FMEP) are accounted for. Brake Mean Effective Pressure (BMEP) is the engine's brake torque output expressed in terms of a mean effective pressure (MEP) value. BMEP is equal to the brake torque divided by engine displacement. This is the performance parameter taken after the losses due to friction. Accordingly, BMEP=IMEP−friction. Friction, in this case is usually also expressed in terms of an MEP value known as Frictional Mean Effective Pressure (or FMEP).

Compressor: The compression cylinder and its associated compression piston of a split-cycle engine.

Expander: The expansion cylinder and its associated expansion piston of a split-cycle engine.

IMEP: Indicated Mean Effective Pressure. The term "Indicated" refers to the output as delivered to the top of the piston, before friction losses (FMEP) are accounted for.

RPM: Revolutions Per Minute.

Tank valve: Valve connecting the Xovr passage with the compressed air storage tank.

VVA: Variable valve actuation. A mechanism or method operable to alter the shape or timing of a valve's lift profile.

Xovr (or Xover) valve, passage or port: The crossover valves, passages, and/or ports which connect the compression and expansion cylinders through which gas flows from compression to expansion cylinder.

XovrC (or XoverC) valves: Valves at the compressor end of the Xovr passage.

XovrE (or XoverE) valves: Valves at the expander end of the crossover (Xovr) passage.

Figure 1:
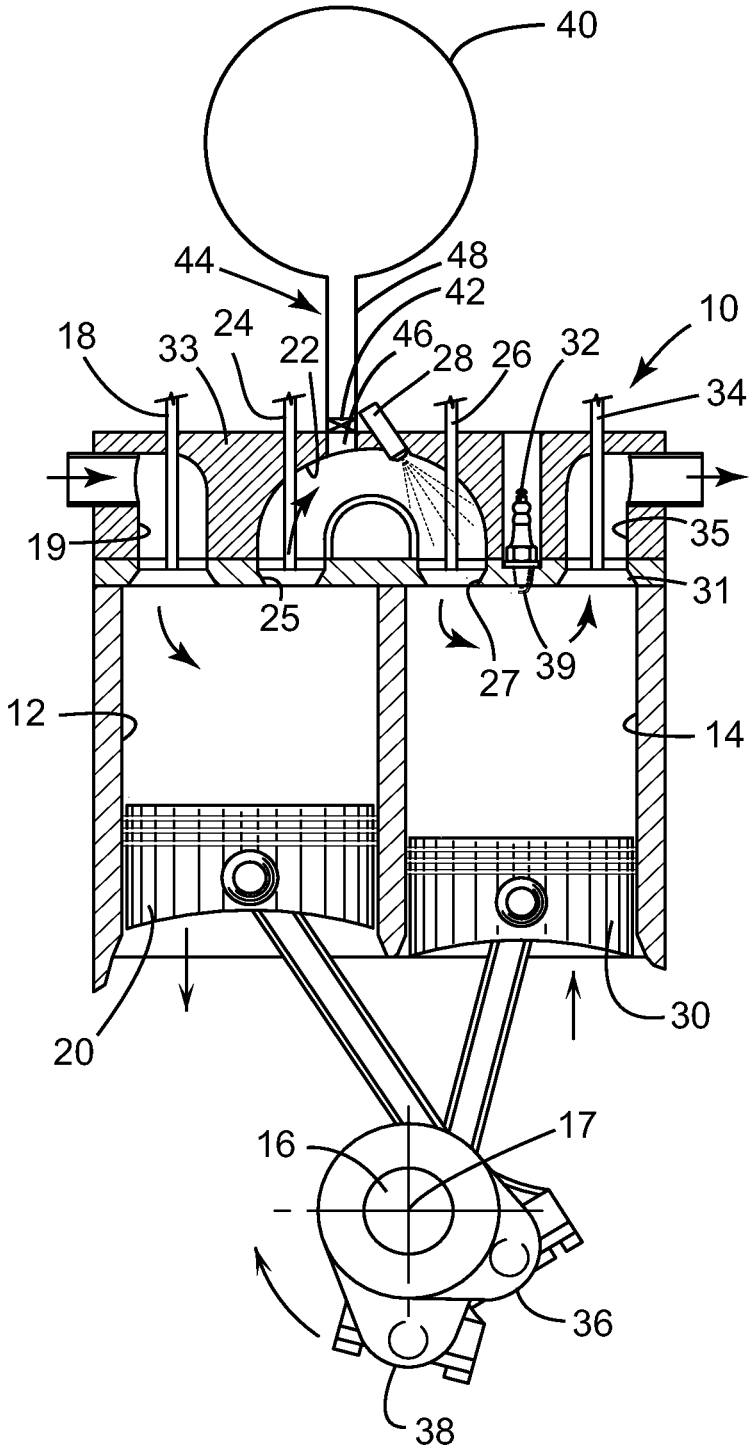
FIG. 1 is a lateral sectional view of an exemplary split-cycle air-hybrid engine in accordance with the present invention.

Referring to FIG. 1, an exemplary split-cycle air-hybrid engine is shown generally by numeral 10. The split-cycle air-hybrid engine 10 replaces two adjacent cylinders of a conventional engine with a combination of one compression cylinder 12 and one expansion cylinder 14. A cylinder head 33 is typically disposed over an open end of the expansion and compression cylinders 12, 14 to cover and seal the cylinders.

The four strokes of the Otto cycle are "split" over the two cylinders 12 and 14 such that the compression cylinder 12, together with its associated compression piston 20, perform the intake and compression strokes, and the expansion cylinder 14, together with its associated expansion piston 30, perform the expansion and exhaust strokes. The Otto cycle is therefore completed in these two cylinders 12, 14 once per crankshaft 16 revolution (360 degrees CA) about crankshaft axis 17.

During the intake stroke, intake air is drawn into the compression cylinder 12 through an intake port 19 disposed in the cylinder head 33. An inwardly opening (opening inwardly into the cylinder and toward the piston) poppet intake valve 18 controls fluid communication between the intake port 19 and the compression cylinder 12.

During the compression stroke, the compression piston 20 pressurizes the air charge and drives the air charge into the crossover passage (or port) 22, which is typically disposed in the cylinder head 33. This means that the compression cylinder 12 and compression piston 20 are a source of high-pressure gas to the crossover passage 22, which acts as the intake passage for the expansion cylinder 14. In some embodiments, two or more crossover passages 22 interconnect the compression cylinder 12 and the expansion cylinder 14.

The geometric (or volumetric) compression ratio of the compression cylinder 12 of split-cycle engine 10 (and for split-cycle engines in general) is herein commonly referred to as the "compression ratio" of the split-cycle engine. The geometric (or volumetric) compression ratio of the expansion cylinder 14 of split-cycle engine 10 (and for split-cycle engines in general) is herein commonly referred to as the "expansion ratio" of the split-cycle engine. The geometric compression ratio of a cylinder is well known in the art as the ratio of the enclosed (or trapped) volume in the cylinder (including all recesses) when a piston reciprocating therein is at its bottom dead center (BDC) position to the enclosed volume (i.e., clearance volume) in the cylinder when said piston is at its top dead center (TDC) position. Specifically for split-cycle engines as defined herein, the compression ratio of a compression cylinder is determined when the XovrC valve is closed. Also specifically for split-cycle engines as defined herein, the expansion ratio of an expansion cylinder is determined when the XovrE valve is closed.

Due to very high compression ratios (e.g., 20 to 1, 30 to 1, 40 to 1, or greater) within the compression cylinder 12, an outwardly opening (opening outwardly away from the cylinder) poppet crossover compression (XovrC) valve 24 at the crossover passage inlet 25 is used to control flow from the compression cylinder 12 into the crossover passage 22. Due to very high expansion ratios (e.g., 20 to 1, 30 to 1, 40 to 1, or greater) within the expansion cylinder 14, an outwardly opening poppet crossover expansion (XovrE) valve 26 at the outlet 27 of the crossover passage 22 controls flow from the crossover passage 22 into the expansion cylinder 14. The actuation rates and phasing of the XovrC and XovrE valves 24, 26 are timed to maintain pressure in the crossover passage 22 at a high minimum pressure (typically 20 bar or higher at full load) during all four strokes of the Otto cycle.

At least one fuel injector 28 injects fuel into the pressurized air at the exit end of the crossover passage 22 in correspondence with the XovrE valve 26 opening, which occurs shortly before expansion piston 30 reaches its top dead center position. The air/fuel charge enters the expansion cylinder 14 when expansion piston 30 is close to its top dead center position. As piston 30 begins its descent from its top dead center position, and while the XovrE valve 26 is still open, spark plug 32, which includes a spark plug tip 39 that protrudes into cylinder 14, is fired to initiate combustion in the region around the spark plug tip 39. Combustion can be initiated while the expansion piston is between 1 and 30 degrees CA past its top dead center (TDC) position. More preferably, combustion can be initiated while the expansion piston is between 5 and 25 degrees CA past its top dead center (TDC) position. Most preferably, combustion can be initiated while the expansion piston is between 10 and 20 degrees CA past its top dead center (TDC) position. Additionally, combustion may be initiated through other ignition devices and/or methods, such as with glow plugs, microwave ignition devices or through compression ignition methods.

During the exhaust stroke, exhaust gases are pumped out of the expansion cylinder 14 through exhaust port 35 disposed in cylinder head 33. An inwardly opening poppet exhaust valve 34, disposed in the inlet 31 of the exhaust port 35, controls fluid communication between the expansion cylinder 14 and the exhaust port 35. The exhaust valve 34 and the exhaust port 35 are separate from the crossover passage 22. That is, exhaust valve 34 and the exhaust port 35 do not make contact with, or are not disposed in, the crossover passage 22.

With the split-cycle engine concept, the geometric engine parameters (i.e., bore, stroke, connecting rod length, volumetric compression ratio, etc.) of the compression 12 and expansion 14 cylinders are generally independent from one another. For example, the crank throws 36, 38 for the compression cylinder 12 and expansion cylinder 14, respectively, may have different radii and may be phased apart from one another such that top dead center (TDC) of the expansion piston 30 occurs prior to TDC of the compression piston 20. This independence enables the split-cycle engine 10 to potentially achieve higher efficiency levels and greater torques than typical four-stroke engines.

The geometric independence of engine parameters in the split-cycle engine 10 is also one of the main reasons why pressure can be maintained in the crossover passage 22 as discussed earlier. Specifically, the expansion piston 30 reaches its top dead center position prior to the compression piston reaching its top dead center position by a discreet phase angle (typically between 10 and 30 crank angle degrees). This phase angle, together with proper timing of the XovrC valve 24 and the XovrE valve 26, enables the split-cycle engine 10 to maintain pressure in the crossover passage 22 at a high minimum pressure (typically 20 bar absolute or higher during full load operation) during all four strokes of its pressure/volume cycle. That is, the split-cycle engine 10 is operable to time the XovrC valve 24 and the XovrE valve 26 such that the XovrC and XovrE valves are both open for a substantial period of time (or period of crankshaft rotation) during which the expansion piston 30 descends from its TDC position towards its BDC position and the compression piston 20 simultaneously ascends from its BDC position towards its TDC position. During the period of time (or crankshaft rotation) that the crossover valves 24, 26 are both open, a substantially equal mass of air is transferred (1) from the compression cylinder 12 into the crossover passage 22 and (2) from the crossover passage 22 to the expansion cylinder 14. Accordingly, during this period, the pressure in the crossover passage is prevented from dropping below a predetermined minimum pressure (typically 20, 30, or 40 bar absolute during full load operation). Moreover, during a substantial portion of the engine cycle (typically 80% of the entire engine cycle or greater), the XovrC valve 24 and XovrE valve 26 are both closed to maintain the mass of trapped gas in the crossover passage 22 at a substantially constant level. As a result, the pressure in the crossover passage 22 is maintained at a predetermined minimum pressure during all four strokes of the engine's pressure/volume cycle.

For purposes herein, the method of having the XovrC 24 and XovrE 26 valves open while the expansion piston 30 is descending from TDC and the compression piston 20 is ascending toward TDC in order to simultaneously transfer a substantially equal mass of gas into and out of the crossover passage 22 is referred to herein as the Push-Pull method of gas transfer. It is the Push-Pull method that enables the pressure in the crossover passage 22 of the split-cycle engine 10 to be maintained at typically 20 bar or higher during all four strokes of the engine's cycle when the engine is operating at full load.

As discussed earlier, the exhaust valve 34 is disposed in the exhaust port 35 of the cylinder head 33 separate from the crossover passage 22. The structural arrangement of the exhaust valve 34 not being disposed in the crossover passage 22, and therefore the exhaust port 35 not sharing any common portion with the crossover passage 22, is preferred in order to maintain the trapped mass of gas in the crossover passage 22 during the exhaust stroke. Accordingly, large cyclic drops in pressure are prevented which may force the pressure in the crossover passage below the predetermined minimum pressure.

XovrE valve 26 opens shortly before the expansion piston 30 reaches its top dead center position. At this time, the pressure ratio of the pressure in crossover passage 22 to the pressure in expansion cylinder 14 is high, due to the fact that the minimum pressure in the crossover passage is typically 20 bar absolute or higher and the pressure in the expansion cylinder during the exhaust stroke is typically about one to two bar absolute. In other words, when XovrE valve 26 opens, the pressure in crossover passage 22 is substantially higher than the pressure in expansion cylinder 14 (typically in the order of 20 to 1 or greater). This high pressure ratio causes initial flow of the air and/or fuel charge to flow into expansion cylinder 14 at high speeds. These high flow speeds can reach the speed of sound, which is referred to as sonic flow. This sonic flow is particularly advantageous to split-cycle engine 10 because it causes a rapid combustion event, which enables the split-cycle engine 10 to maintain high combustion pressures even though ignition is initiated while the expansion piston 30 is descending from its top dead center position.

The split-cycle air-hybrid engine 10 also includes an air reservoir (tank) 40, which is operatively connected to the crossover passage 22 by an air reservoir (tank) valve 42. Embodiments with two or more crossover passages 22 may include a tank valve 42 for each crossover passage 22, which connect to a common air reservoir 40, or alternatively each crossover passage 22 may operatively connect to separate air reservoirs 40.

The tank valve 42 is typically disposed in an air reservoir (tank) port 44, which extends from crossover passage 22 to the air tank 40. The air tank port 44 is divided into a first air reservoir (tank) port section 46 and a second air reservoir (tank) port section 48. The first air tank port section 46 connects the air tank valve 42 to the crossover passage 22, and the second air tank port section 48 connects the air tank valve 42 to the air tank 40. The volume of the first air tank port section 46 includes the volume of all additional ports and recesses which connect the tank valve 42 to the crossover passage 22 when the tank valve 42 is closed.

The tank valve 42 may be any suitable valve device or system. For example, the tank valve 42 may be an active valve which is activated by various valve actuation devices (e.g., pneumatic, hydraulic, cam, electric or the like). Additionally, the tank valve 42 may comprise a tank valve system with two or more valves actuated with two or more actuation devices.

Air tank 40 is utilized to store energy in the form of compressed air and to later use that compressed air to power the crankshaft 16, as described in the aforementioned U.S. Pat. No. 7,353,786 to Scuderi et al. This mechanical means for storing potential energy provides numerous potential advantages over the current state of the art. For instance, the split-cycle engine 10 can potentially provide many advantages in fuel efficiency gains and NOx emissions reduction at relatively low manufacturing and waste disposal costs in relation to other technologies on the market, such as diesel engines and electric-hybrid systems.

By selectively controlling the opening and/or closing of the air tank valve 42 and thereby controlling communication of the air tank 40 with the crossover passage 22, the split-cycle air-hybrid engine 10 is operable in an Engine Firing (EF) mode, an Air Expander (AE) mode, an Air Compressor (AC) mode, an Air Expander and Firing (AEF) mode, and a Firing and Charging (FC) mode. The EF mode is a non-hybrid mode in which the engine operates as described above without the use of the air tank 40. The AC and FC modes are energy storage modes. The AC mode is an air-hybrid operating mode in which compressed air is stored in the air tank 40 without combustion occurring in the expansion cylinder 14 (i.e., no fuel expenditure), such as by utilizing the kinetic energy of a vehicle including the engine 10 during braking. The FC mode is an air-hybrid operating mode in which excess compressed air not needed for combustion is stored in the air tank 40, such as at less than full engine load (e.g., engine idle, vehicle cruising at constant speed). The storage of compressed air in the FC mode has an energy cost (penalty); therefore, it is desirable to have a net gain when the compressed air is used at a later time. The AE and AEF modes are stored energy usage modes. The AE mode is an air-hybrid operating mode in which compressed air stored in the air tank 40 is used to drive the expansion piston 30 without combustion occurring in the expansion cylinder 14 (i.e., no fuel expenditure). The AEF mode is an air-hybrid operating mode in which compressed air stored in the air tank 40 is utilized in the expansion cylinder 14 for combustion.

In the AEF mode, the air tank valve 42 is preferably kept open through the entire rotation of the crankshaft 16 (i.e., the air tank valve 42 is kept open at least during the entire expansion stroke and exhaust stroke of the expansion piston). Thus, compressed air stored in the air tank 40 is released from the air tank 40 into the crossover passage 22 to provide charge air for the expansion cylinder 14. Also, the XovrC valve 24 is kept closed through the entire rotation of the crankshaft 16, thereby isolating the compression cylinder 12, which may be deactivated. The expansion piston 30 operates in its power mode, in that compressed air (from the air tank 40) is admitted to the expansion cylinder 14 with fuel, at the beginning of an expansion stroke, which is ignited, burned and expanded on the same expansion stroke of the expansion piston 30, transmitting power to the crankshaft 16, and the combustion products are discharged on the exhaust stroke.

The timing of the XovrE valve 26 closing at the beginning of the expansion stroke (as the expansion piston 30 descends from top dead center) is significant to the efficiency of the engine 10 in the AEF mode. This is because, when the XovrE valve 26 is open, the volume of the crossover passage 22 is part of the clearance space above the piston wherein combustion takes place. Yet virtually all of the fuel is in the expansion cylinder 14, and none of it is in the crossover passage 22. Once the XovrE valve 26 is closed, the entire combustion process is confined to the expansion cylinder 14, and the expanding combusting mass of fuel and air can most effectively do work upon the piston 30.

The later the XovrE valve 26 closes, the smaller the residual (i.e., effective volumetric) expansion ratio, which is defined as the ratio (a/b) of (a) the trapped volume in the expansion cylinder 14 (i.e., the volume of a chamber generally defined by the cylinder 14 wall, the top of the expansion piston 30, and the bottom of the cylinder head 33) when the expansion piston 30 is at bottom dead center to (b) the trapped volume in the expansion cylinder 14 at the time just when the XovrE valve 26 closes. Once the XovrE valve 26 is closed during the expansion stroke of the expansion piston 30, the expanding trapped mass is present solely in the expansion cylinder 14 and work is produced as the mass expands. Clearly, the later the XovrE valve 26 closes, the farther the expansion piston 30 is from top dead center, thus the smaller the residual expansion ratio and the less work that is produced during the expansion stroke.

Figure 2:
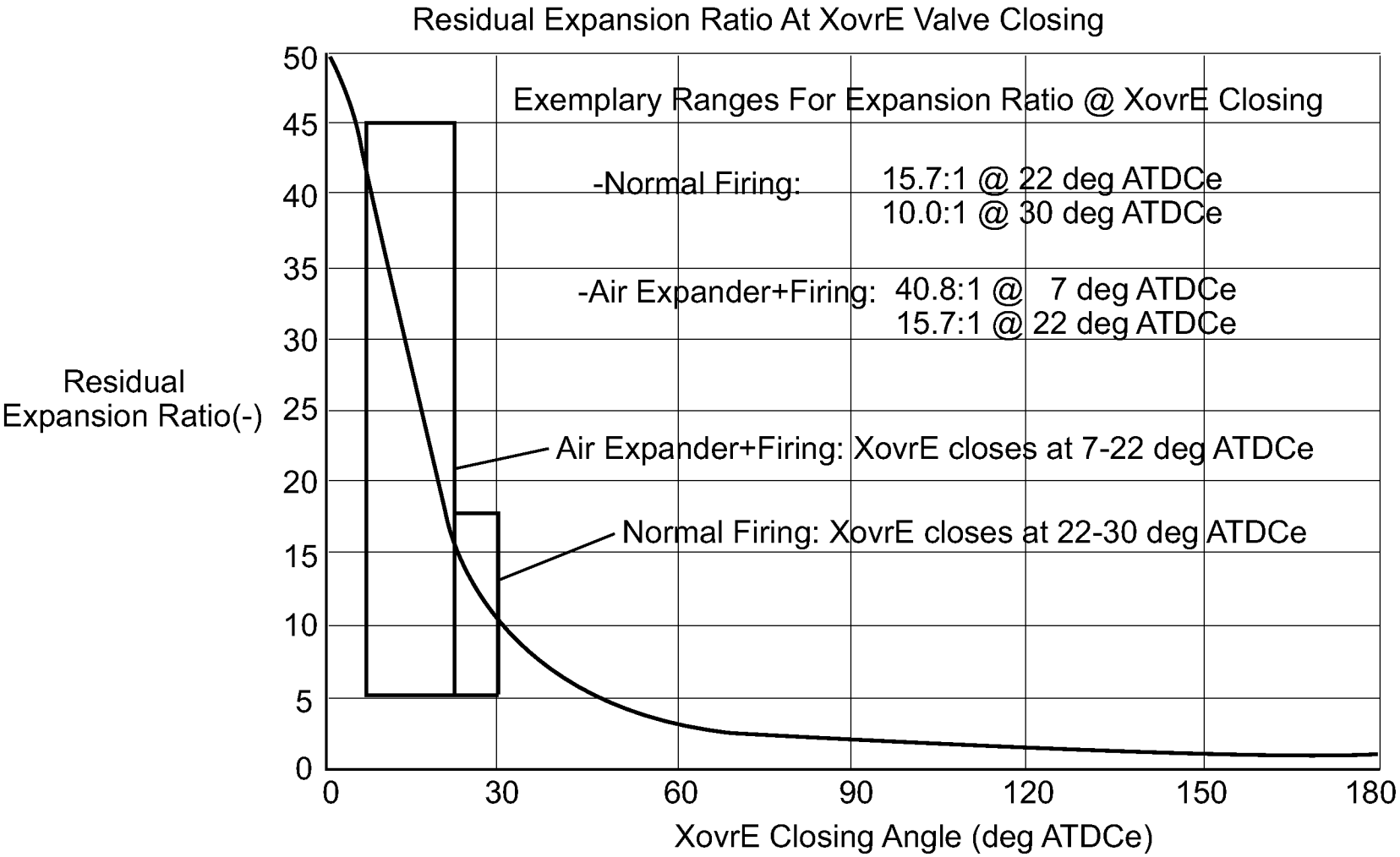
FIG. 2 is a graphical illustration of a preferred exemplary range of residual expansion ratio (i.e., effective volumetric expansion ratio) versus closing angle of a crossover expansion (XovrE) valve in accordance with the present invention.

As shown in FIG. 2, to avoid significant deterioration in engine efficiency in the AEF mode, the residual expansion ratio should be 15.7:1 or greater. More preferably, the residual expansion ratio should be in the range of 15.7:1 and 40.8:1. In this exemplary embodiment, in order to achieve a residual expansion ratio of 15.7:1 or greater, the XovrE valve should be closed at approximately 22 degrees CA or less ATDCe. Also in this exemplary embodiment, in order to achieve a residual expansion ratio of 40.8:1 or greater, the XovrE valve should be closed at approximately 7 degrees CA or less ATDCe.

The upper range of the residual expansion ratio in the AEF mode is always greater than the upper range of the residual expansion ratio in an Engine Firing (EF) mode for any given application (i.e., at any given engine load and engine speed). Also, the actual residual expansion ratio in the AEF mode is typically greater than the actual residual expansion ratio in an Engine Firing (EF) mode of the engine, particularly when the air tank is substantially full (i.e., when the air tank pressure is at approximately two-thirds the rated full pressure, for example 20 bar or above out of a possible 30 bar full tank). In the EF mode, the compressed air used for combustion in the expansion cylinder is provided by the compression cylinder. In order to produce the compressed air, the compression cylinder must perform negative pumping work (y). Thus, in order to obtain the desired load output (x), the expansion piston must produce a total amount of work equal to x+y so that the net output is x+y−y=x. In contrast, in the AEF mode the compressed air used for combustion in the expansion cylinder is provided from compressed air previously stored in the air tank. Since the compression cylinder does not have to produce compressed air in the AEF mode, the compression cylinder is preferably deactivated, and as such the compression piston performs little to no negative pumping work. Thus, in order to obtain the desired load output (x), the expansion piston only needs to produce a total amount of work equal to approximately x. Because the amount of work produced by the expansion piston in the EF and AEF modes is essentially dependent upon the mass of fuel that is consumed, and further because the mass of air needed in the expansion cylinder is directly related to the mass of fuel (in order to maintain a suitable, e.g., stoichiometric, air to fuel ratio), a greater amount of compressed air is required in the EF mode than in the AEF mode to produce the same net load output. For the expansion cylinder to receive a greater amount of compressed air, the XovrE valve generally must be held open longer in the EF mode than in the AEF mode. The longer the XovrE valve is held open, the lower the residual expansion ratio. Hence, the residual expansion ratio generally is greater in the AEF mode than in the EF mode for a given engine load.

Figure 3:
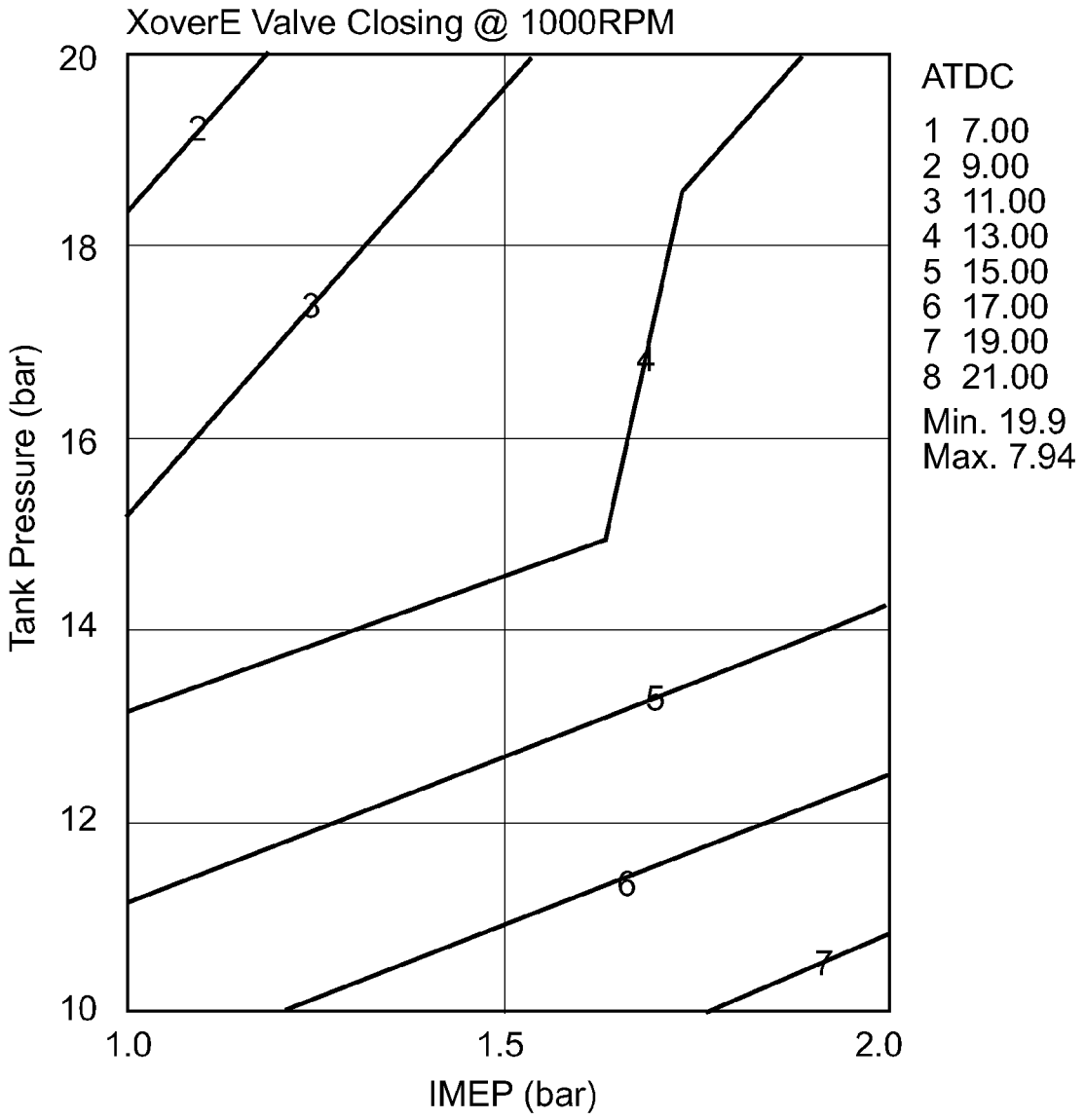
FIG. 3 is a graphical illustration of XovrE valve closing timing with respect to tank pressure and load at an engine speed of 1000 revolutions per minute (rpm)
Figure 4:
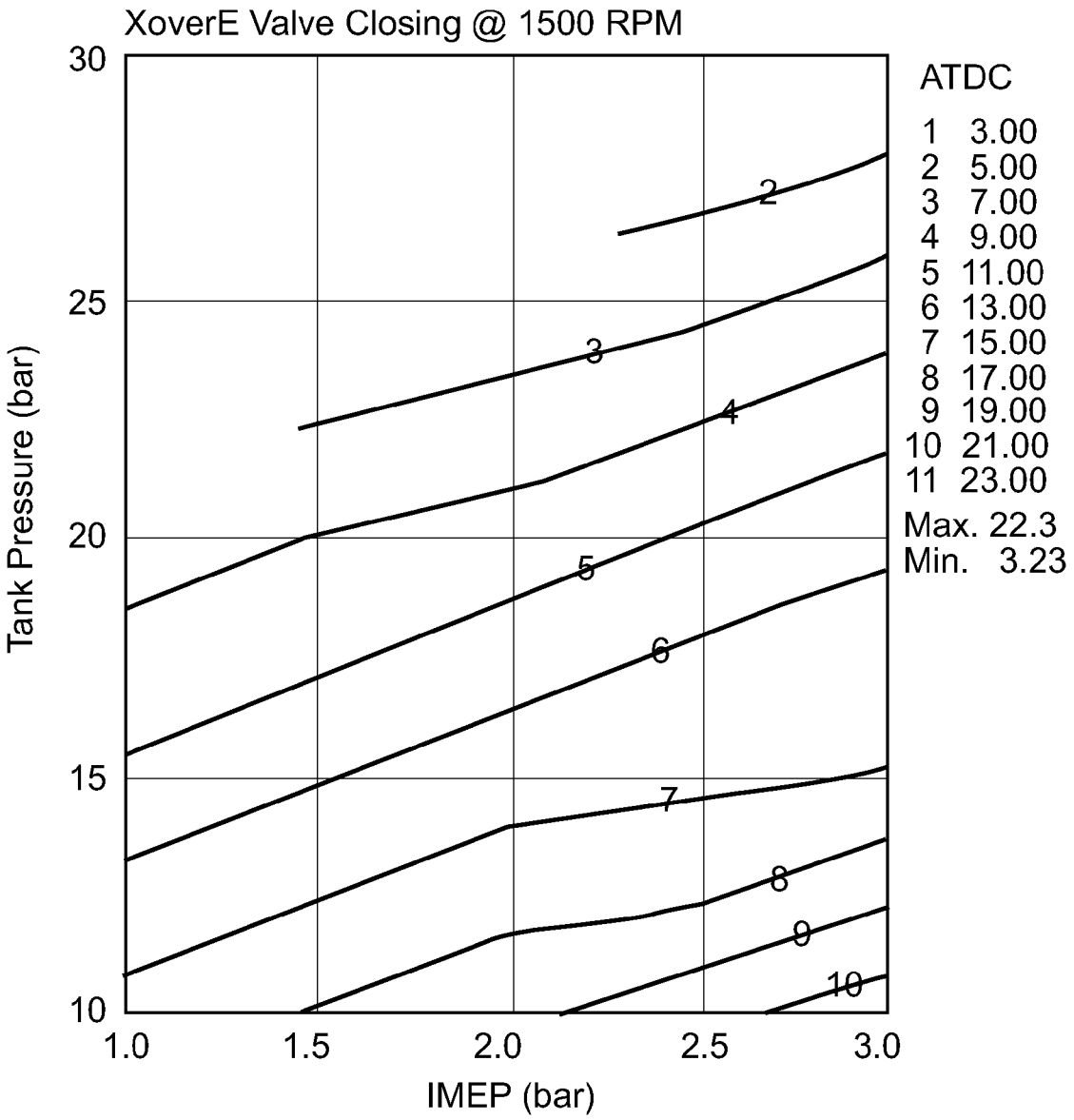
FIG. 4 is a graphical illustration of XovrE valve closing timing with respect to tank pressure and load at an engine speed of 1500 rpm.
Figure 5:
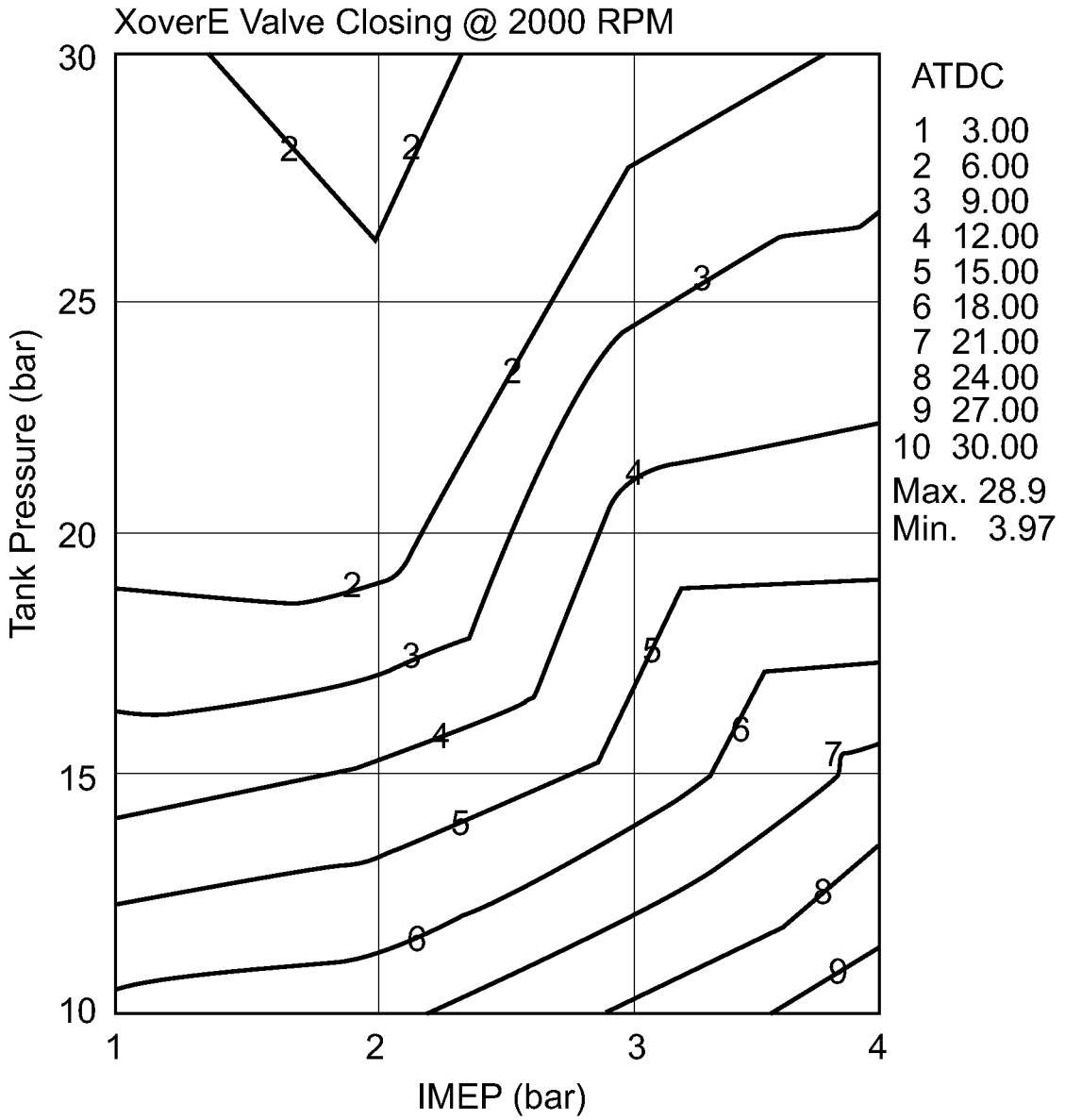
FIG. 5 is a graphical illustration of XovrE valve closing timing with respect to tank pressure and load at an engine speed of 2000 rpm.
Figure 6:
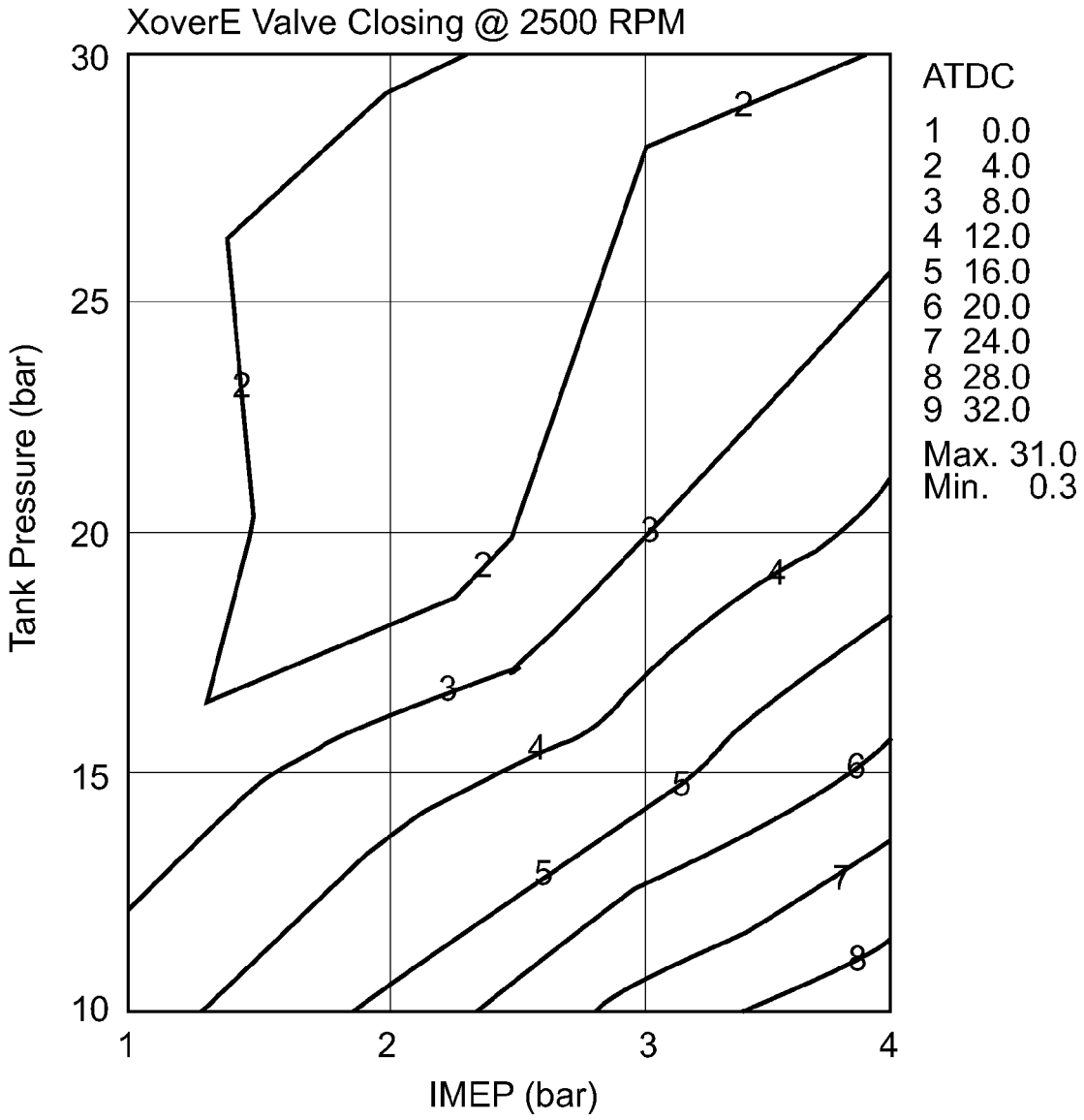
FIG. 6 is a graphical illustration of XovrE valve closing timing with respect to tank pressure and load at an engine speed of 2500 rpm.
Figure 7:
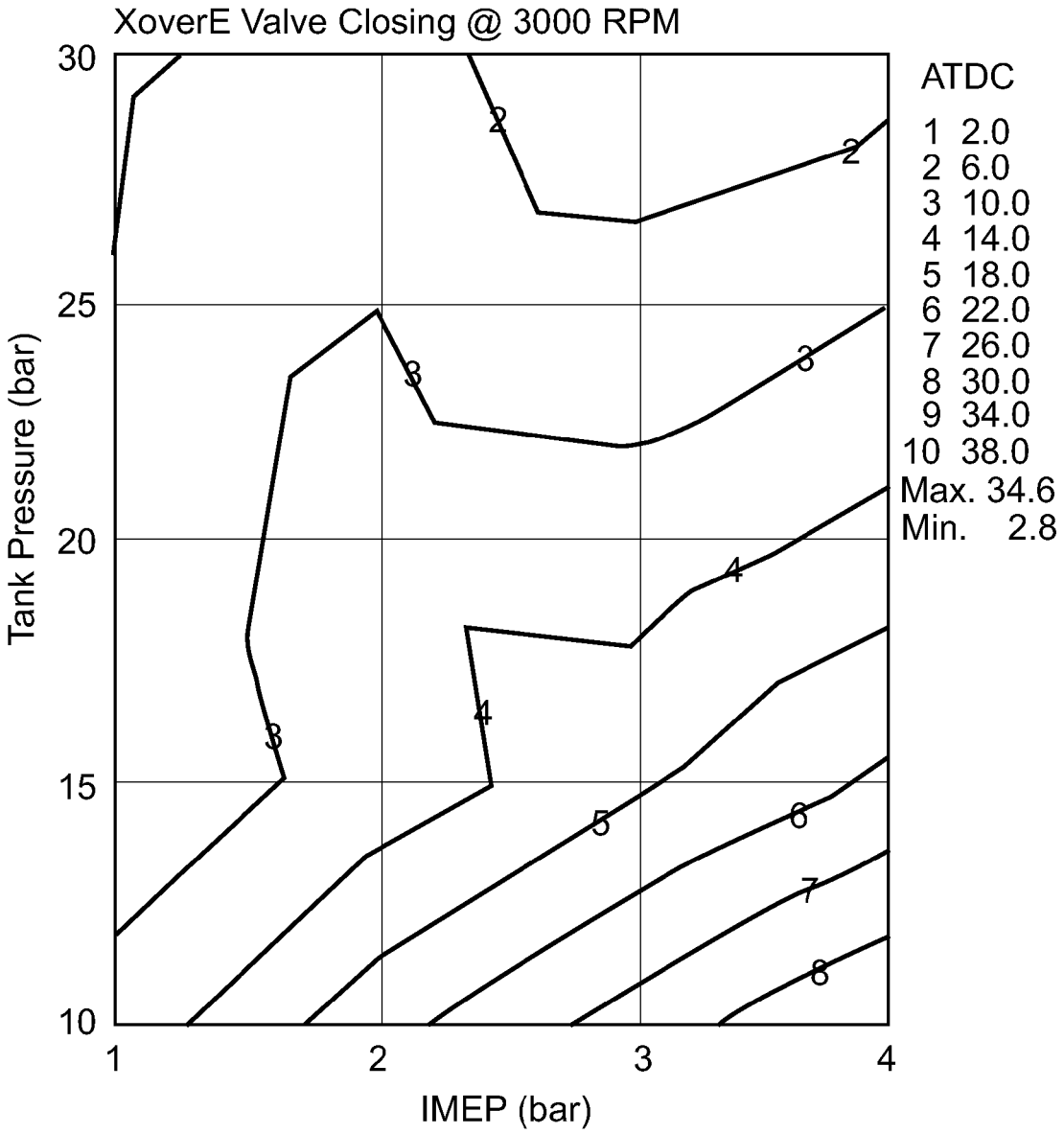
FIG. 7 is a graphical illustration of XovrE valve closing timing with respect to tank pressure and load at an engine speed of 3000 rpm.
Figure 8:
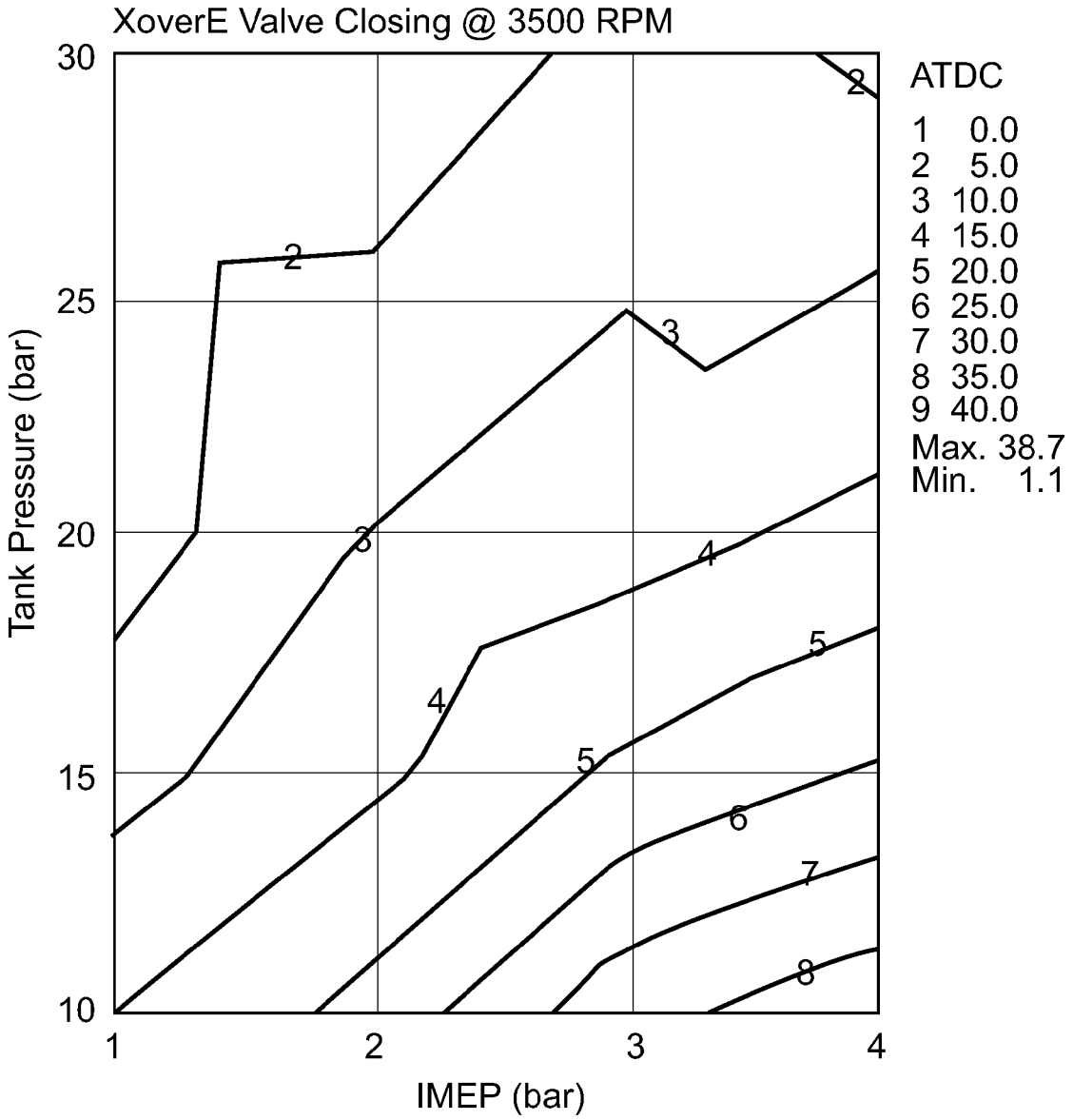
FIG. 8 is a graphical illustration of XovrE valve closing timing with respect to tank pressure and load at an engine speed of 3500 rpm.

FIGS. 3 through 8 are graphical illustrations of exemplary XovrE valve 26 closing timings across a range of engine speeds (1000 to 3500 rpm), engine loads (1 to 4 bar IMEP), and air tank 40 pressures (10 to 30 bar) in the AEF mode. For example: (i) at 1000 rpm, 1.5 bar IMEP, and an air tank pressure of 15 bar, the XovrE valve is closed at approximately 13 degrees ATDCe (FIG. 3); (ii) at 1500 rpm, 2.5 bar IMEP, and an air tank pressure of 15 bar, the XovrE valve is closed at approximately 15 degrees ATDCe (FIG. 4); (iii) at 2000 rpm, 3 bar IMEP, and an air tank pressure of 25 bar, the XovrE valve is closed at approximately 9 degrees ATDCe (FIG. 5); (iv) at 2500 rpm, 3.5 bar IMEP, and an air tank pressure of 15 bar, the XovrE valve is closed at approximately 18 degrees ATDCe (FIG. 6); (v) at 3000 rpm, 4 bar IMEP, and an air tank pressure of 15 bar, the XovrE valve is closed at approximately 22 degrees ATDCe (FIG. 7); and (vi) at 3500 rpm, 2.5 bar IMEP, and an air tank pressure of 25 bar, the XovrE valve is closed at approximately 7 degrees ATDCe (FIG. 8).

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. A split-cycle air-hybrid engine comprising: a crankshaft rotatable about a crankshaft axis; a compression piston slidably received within a compression cylinder and operatively connected to the crankshaft such that the compression piston reciprocates through an intake stroke and a compression stroke during a single rotation of the crankshaft; an expansion piston slidably received within an expansion cylinder and operatively connected to the crankshaft such that the expansion piston reciprocates through an expansion stroke and an exhaust stroke during a single rotation of the crankshaft; a cylinder head disposed over an open end of the expansion cylinder to cover and seal the expansion cylinder; a crossover passage interconnecting the compression and expansion cylinders, the crossover passage including a crossover compression (XovrC) valve and a crossover expansion (XovrE) valve defining a pressure chamber therebetween; a crossover expansion (XovrE) valve disposed in the cylinder head and operable to control flow into the expansion cylinder; an air reservoir operatively connected to the XovrE valve through an air reservoir port, the air reservoir selectively operable to store compressed air from a source of high-pressure gas and to deliver compressed air to the expansion cylinder; and the engine being operable in an Air Expander and Firing (AEF) mode, wherein, in the AEF mode, the engine has a residual expansion ratio at XovrE valve closing of 15.7 to 1 or greater.

2. The engine of claim 1, wherein, in the AEF mode, the residual expansion ratio at XovrE valve closing is in the range of 15.7 to 1 and 40.8 to 1.

3. The engine of claim 1, wherein, in the AEF mode, the XovrE valve is closed at 22 degrees CA or less after top dead center of the expansion piston (ATDCe).

4. The engine of claim 1, wherein, in the AEF mode, the XovrE valve is closed at a position between 7 and 22 degrees CA after top dead center of the expansion piston (ATDCe).

5. The engine of claim 1 having an air reservoir valve disposed in the air reservoir port, the air reservoir valve operable to control air flow into and out of the air reservoir.

6. The engine of claim 5, wherein, in the AEF mode, the air reservoir valve is open.

7. The engine of claim 5, wherein, in the AEF mode, the air reservoir valve is open during the entire expansion stroke and exhaust stroke of the expansion piston.

8. The engine of claim 1, wherein, in the AEF mode, compressed air from the air reservoir is admitted to the expansion cylinder with fuel, at the beginning of an expansion stroke, which is ignited, burned and expanded on the same expansion stroke of the expansion piston, transmitting power to the crankshaft, and the combustion products are discharged on the exhaust stroke.

* * * * *